United States Patent [19]

DeLaney

[11] Patent Number: 5,007,410

[45] Date of Patent: Apr. 16, 1991

[54] VIBRATING MATTRESS

[76] Inventor: Sabrena R. DeLaney, 200 Hampstead Ave., 206-C, Savannah, Ga. 31405

[21] Appl. No.: 440,059

[22] Filed: Nov. 20, 1989

[51] Int. Cl.[5] ..... A61H 1/00

[52] U.S. Cl. ..... 128/33; 5/462; 128/36

[58] Field of Search ..... 128/33, 36, 25 R, 32, 128/35; 5/462, 400, 401, 108, 109

[56] References Cited

U.S. PATENT DOCUMENTS

| | | | |
|---|---|---|---|
| 2,553,873 | 5/1951 | Schwebel, Sr. | 128/36 X |
| 2,920,618 | 1/1960 | Oster, Jr. | 128/36 X |
| 3,890,963 | 6/1975 | Patterson | 128/33 X |
| 4,030,487 | 6/1977 | McEachran | 128/33 X |
| 4,136,685 | 1/1979 | Ramey | 128/33 |
| 4,326,506 | 4/1982 | Kawabata | 5/462 X |
| 4,365,371 | 12/1982 | Boussaroque | 5/462 |
| 4,757,548 | 7/1988 | Fenner, Jr. | 128/33 X |

FOREIGN PATENT DOCUMENTS

| | | | |
|---|---|---|---|
| 309412 | 3/1989 | European Pat. Off. | 128/36 |

*Primary Examiner*—Edgar S. Burr
*Assistant Examiner*—Moshe I. Cohen
*Attorney, Agent, or Firm*—David H. Semmes

[57] ABSTRACT

A vibrating matress containing a plurality of independently controlled vibrating units positioned within the mattress in a manner, so as to impart a vibrating resonance along the length of the mattress for the comfort of a person reclining upon the mattress. Each vibrating unit is comprised of a motor and a shaft to which is attached an adjustable eccentric weight that imparts vibrations when in operation. The location of the vibrating units can be changed within the resilient mattress layers, so as to conform to the physical requirements of the individual reclining on the mattress. Battery operated, individual switches with variable resistors control the frequency of each vibrating unit. Operation of the vibrating units may thus impart the desired level of resonance to slowly and quietly lull an individual to sleep.

2 Claims, 3 Drawing Sheets

VIBRATING MATTRESS

BACKGROUND OF THE INVENTION

1. Field of the Invention

The invention relates to mattresses, and more specifically, to apparatus for imparting vibrations to a mattress and a human figure reclining thereon.

2. Description of the Prior Art

A vibrating mattress especially adapted for enhancing sleep or mildly massaging the infant or adult reclining figure. The mattress contains a plurality of independently controlling vibrating units arranged in a manner to impart variable frequency vibrations along the length of the mattress. The invention is characterized by its capability of resonating the vibration of individual vibrating units, so as to enhance the comforting effect.

SUMMARY OF THE INVENTION

The present invention includes a plurality of independently controlled vibrating units positioned within a foam rubber mattress in a manner to impart variable frequency vibratory impulses to the mattress. Each vibrating unit is comprised of a plastic frame which houses a variable speed motor with a shaft and eccentric weight causing the motor to vibrate when in use. The frequency of the vibrations produced within the mattress may be controlled by varying the speed of each motor. The amplitude of the vibration may be controlled by re-positioning the eccentric weight. Operation of the individual vibrating units thusly imparts a resonating effect to the mattress and to a person reclining upon the mattress. By varying the frequencies of the vibratory impulses and the level of resonance, a person may recline upon the mattress for its comforting effects or, alternatively, be slowly lulled to sleep.

DESCRIPTION OF THE PREFERRED EMBODIMENTS

Figure 1:
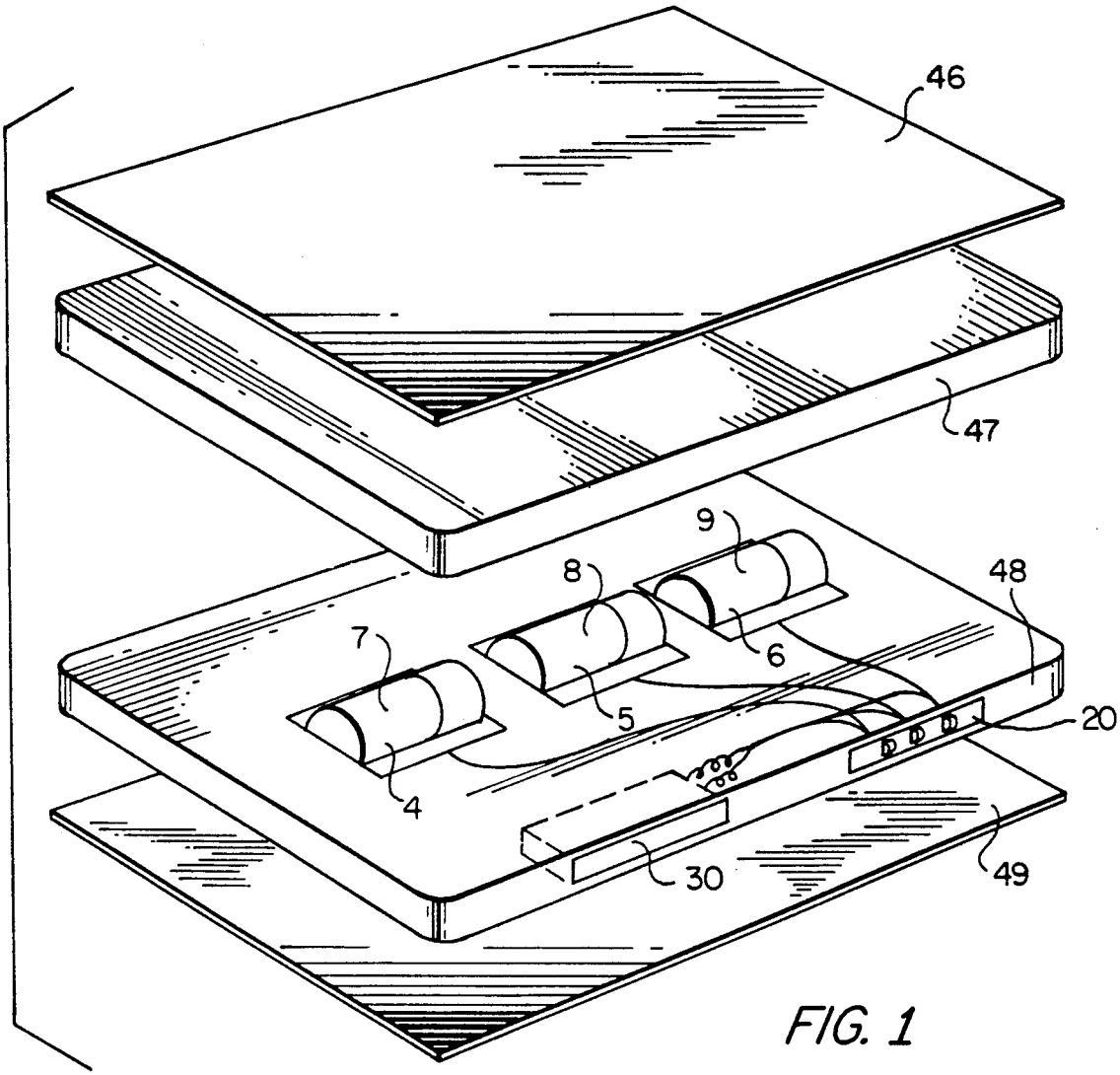
FIG. 1 is an exploded view of the vibrating mattress showing the positioning of three vibrating units within the resilient mattress layers.
Figure 2:
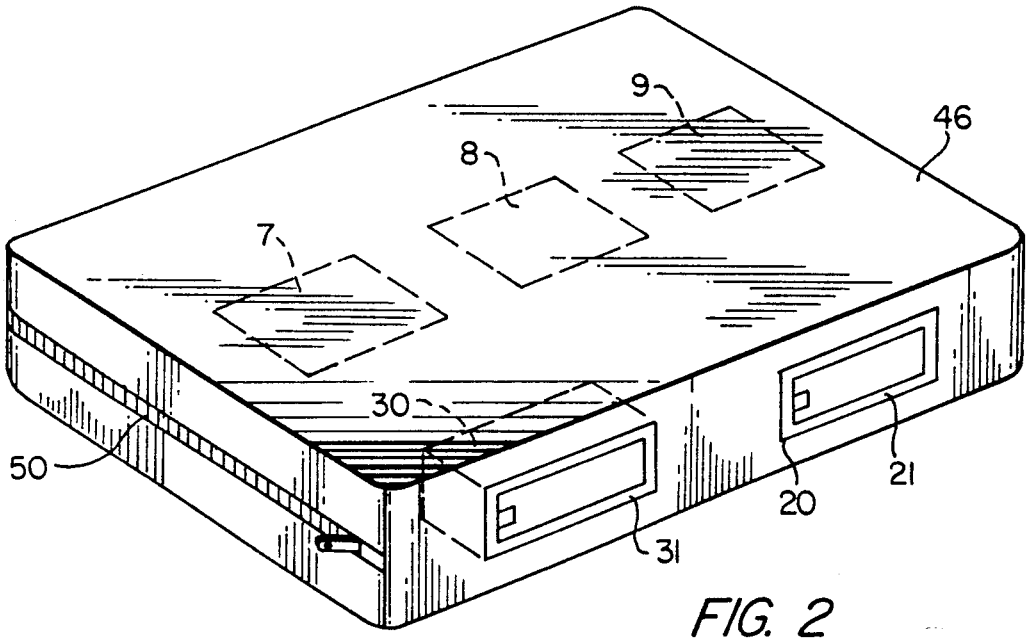
FIG. 2 is a perspective view of the assembled mattress showing the zipper and the protective covers for both the battery and on-off switch panel.

Referring to FIGS. 1 and 2, there is shown a conventional mattress constructed of foam rubber layers 47,48 with corresponding top 46 and bottom 49 plastic mattress covers. Such mattresses are in widespread usage and readily available in varying thicknesses, and may be constructed of any suitable resilient mattress material. Positioned within the mattress are vibrating units 7,8 and 9 with corresponding variable speed motors 4,5 and 6. Mattress covers 46 and 49 may be equipped with zipper 50 along three sides so as to enable the user to easily and readily change the position of vibrating units 7,8 and 9 within the resilient mattress layers. Additional vibrating units may also be installed within the mattress if desired. Since each vibrating unit is identical in construction, a description of vibrating unit 9 follows.

Figure 3:
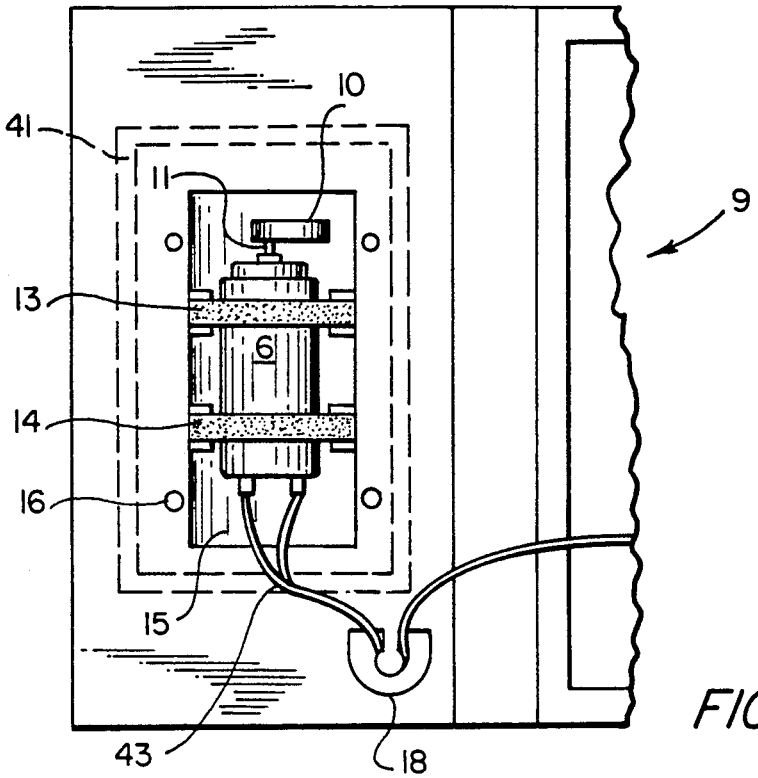
FIG. 3 is a fragmentary top plan of the vibrating unit illustrated in FIG. 1, showing a variable speed motor with eccentric cam positioned upon a frame and the protective pivoted housing cover.

As seen in FIG. 3, vibrating unit 9 includes variable speed motor 6 with output shaft 11 to which is attached eccentric cam 10. Eccentric cam 10 is a circular steel weight of varying diameters and thicknesses coupled at one end to motor shaft 11. By shifting the weight of eccentric cam 10 of motor 6, the amplitude of the vibratory impulses may be varied. Sufficient clearance is provided within motor frame or receptacle 15 to prevent eccentric cam 10 contacting the wall of vibrating unit 9 and, thusly, ensuring minimal noise level when in operation.

Figure 4:
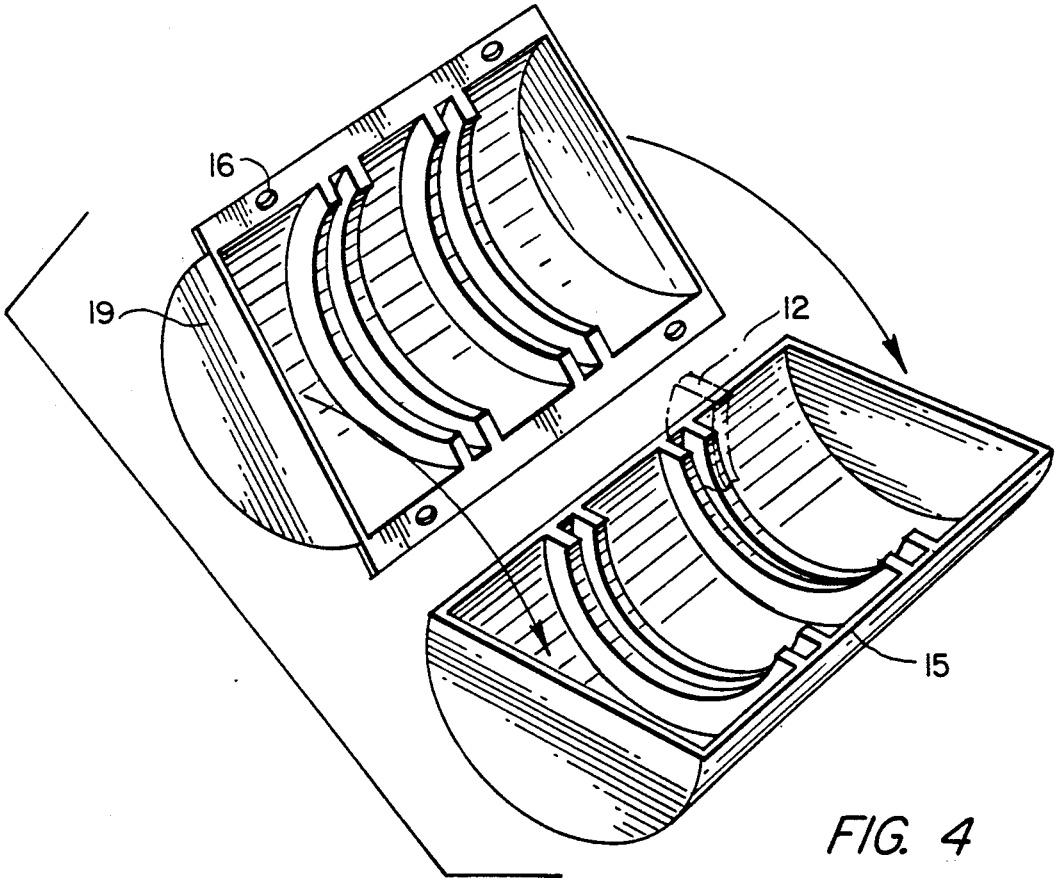
FIG. 4 is an exploded view of the motor housing.

Referring to FIGS. 3 and 4, plastic vibrating unit 9 contains frame or receptacle 15 for motor 6. Motor 6 is mounted within receptacle 15 by means of grooves 12 and complementary rubber gaskets 13 and 14 which encircle motor 6. Thus, mechanical impulses transmitted from motor 6 to plastic vibrating unit 9 are damped by rubber gaskets 13 and 14. Pivoted motor housing cover 19 also contains complemental grooves 12 for rubber gaskets 13 and 14. Motor housing cover 19 is held firmly in place with screws 16 and adhesive or hook and loop fasteners such as Velcro type border 41. Activating wire 42 and ground wire 43 from motor 6 to on-off switch 26 are secured in place by wire catch 18 located on vibrating unit 9.

Figure 5:
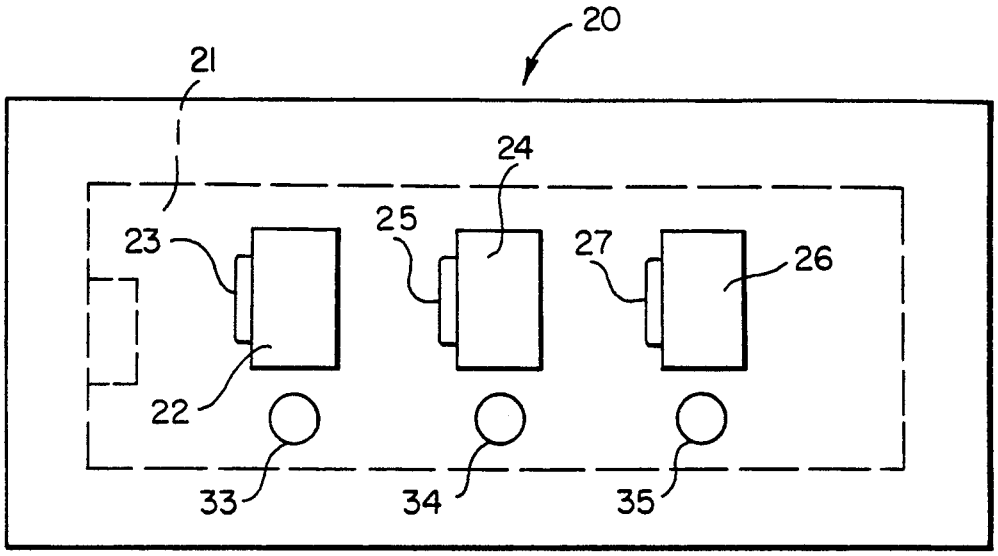
FIG. 5 is an enlarged side elevation of the on-off switch panel showing individual on-off switches and adjacent safety lights.

Each of the vibrating units 7,8, and 9 is independently controlled by corresponding on-off switches 22,24 and 26 and individually variable resistors or rheostats 23,25 and 27 located in switch panel 20. Switch panel 20 may be positioned on the side of the mattress and includes protective pivoted cover 21 with closure, as seen in FIGS. 2 and 5. Individual safety lights 33,34 and 35 are positioned on switch panel 20 and monitor the on-off status of the unit, so as to prevent inadvertant operation. Since each on-off switch is identical, only on-off switch 26 will be described.

Figure 6:
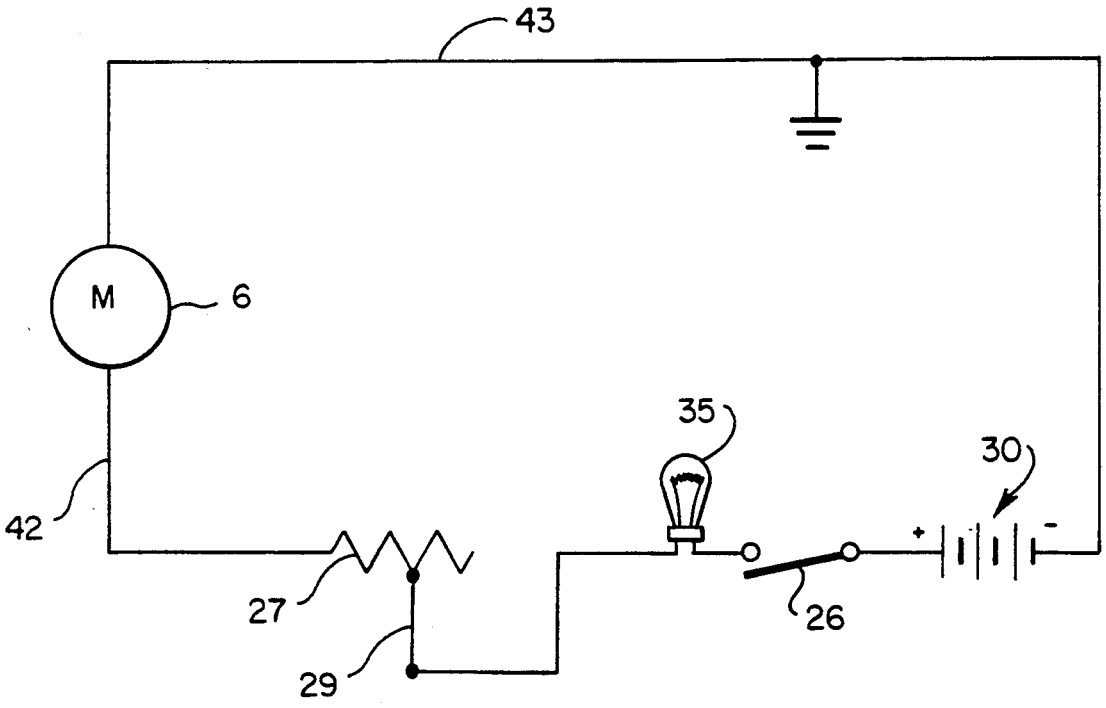
FIG. 6 is a circuit diagram of the control circuit of the unit shown in FIGS. 1 and 3.

Referring to FIGS. 5 and 6, supply voltage is applied from 6-volt battery 30 to motor 6 through on-off switch 26 and variable resistor or rheostat 27. Rheostat 27 includes wiper arm 29 which enables the voltage to motor 6 to be increased or decreased to the desired level. Battery 30 is located on the side of the mattress and, like switch panel 20, may include protective pivoted cover 31 with Velcro type closure. Motor 6 is capable of vibrating at a variety of frequencies, depending upon the level of inducing current to motor 6 and the adjusted amplitude of vibration. Variable resistor or rheostat 27 controls the level of inducing current and, thus, the frequency of vibrations and combined resonating effect. The amplitude of vibration can be varied by altering the level of inducing current to motor 6 and by adjusting the weight of eccentric cam 10 of motor 6. Thus, the speed of operation and frequency of vibrations produced within vibrating unit 9 and the foam mattress may be readily and easily adjusted for the desired resonating effect. In the present invention, the preferred power supply is 6-volt battery 30 allowing sufficient current to produce a vibrating frequency in each vibrating unit 9 of approximately one to 150 cycles per second.

The vibrating mattress is simple in design and, therefore, relatively inexpensive to commercially manufacture. Additionally, the vibrating mattress is easy to use and efficient in operation. Vibratory movement in the form of a combined resonance can be safely and effectively imparted from individual vibrating units 7,8 and 9 to the mattress and thus to an infant, adult or patient reclining upon the mattress.

Conventional mattress vibrators and bed vibrating devices are either mounted upon the bed frame or upon underlying mattress supporting grids. When in operation, such conventional devices may produce a high level of noise due to rattling of the surrounding bed and mattress frame. Structural damage to the bed frame and supporting grids caused by such rattling is not uncommon. Due to positioning of plastic vibrating units 7,8 and 9 within layers of foam rubber or other resilient mattress padding, the present invention alleviates these problems. Also, sufficient clearance is provided so that eccentric cam 10 does not come in contact with the wall or frame of motor receptacle 15, thereby reducing noise level to an absolute minimum.

The present invention provides, also, the advantage of battery operation whereby battery 30 conveniently located on the side of the mattress is easily accessible for removal and replacement. Battery 30 is also equipped with protective pivoted cover 31 with Velcro type closure, providing maximal safety. Manifestly, positions of the individual vibrating units 7,8 and 9 may be easily and readily varied within the mattress, according to the size or physical requirements of the child or patient.

Vibrating units 7,8 and 9 are independently controlled via on-off switches 22,24 and 26 conveniently located on the side of the mattress within switch panel 20, which is also equipped with protective pivoted cover 21 with Velcro or like closure. Adjacent safety lights 33,34 and 35 readily alert the user to inadvertant operation of the invention. Variable resistors or rheostats 23,25 and 27 effectively control the level of inducing current to motors 4,5 and 6, respectively, and thus control the frequency of vibrations and level of combined resonance within the mattress. A person may be slowly lulled to sleep using a lower frequency of vibrations and resonance, or alternatively, may be slowly awakened using a higher frequency of vibratory movement and resonance. The level of vibratory movement within the mattress may also be controlled by the number of vibrating units in actual operation. Further, the frequency of vibration of the individual units 7,8 and 9 may be varied such that a vibratory resonance may be imparted to the mattress. Such resonance may be selectively varied, according to the specific needs of the sleeping child or patient. Thus the present invention is capable of safely and easily imparting a level of vibratory movement and resonance to the mattress to produce the desired comforting effect.

I claim:

1. In a mattress of the type adapted for imparting vibrations to a reclining human, the combination comprising:

(a) top and bottom resilient members sandwiched upon each other;

(b) at least two vibrating units positioned between said resilient members, each vibrating until including:

(i) a frame support and a protective housing mounted securely thereto;

(ii) an eccentric motor mounted upon said frame and within said protective housing, further including a shaft supporting an adjustable eccentric weight as a control for varying the amplitude of vibrations;

(iii) a power source and enabling circuit activating said motor in the form of a storage battery positioned on one side of said mattress and between said resilient members and externally accessible to facilitate battery charge, said power source having a protective pivoted cover with closure;

(iv) and on/off switch within said circuit and presented on one side of said resilient members, so as to be externally actuable;

(v) a safety light mounted adjacent each on/off switch, so as to enable monitoring and operation of each said vibrating unit;

(vi) a pivotable protective cover with closure for each said switch; and (c) a resonating means in the form of a variable resistor positioned in said enabling circuit, so as to vary the frequency vibration of each said vibrating unit.

2. Apparatus as defined in claim 1, wherein said mattress includes a zipper to enable repositioning of said vibrating units, so as to conform to the physical requirements of the individual human figure.

* * * * *